US009427787B2

(12) United States Patent
Haverkamp et al.

(10) Patent No.: US 9,427,787 B2
(45) Date of Patent: Aug. 30, 2016

(54) METHOD AND APPARATUS FOR MAKING COLD-PILGER-ROLLED TUBES

(75) Inventors: Mark Haverkamp, Duesseldorf (DE); Martin Sauerland, Niederkruechten (DE); Michael Baensch, Rheinberg (DE)

(73) Assignee: SMS MEER GmbH, Moenchengladbach (DE)

( * ) Notice: Subject to any disclaimer, the term of this patent is extended or adjusted under 35 U.S.C. 154(b) by 520 days.

(21) Appl. No.: 13/587,429

(22) Filed: Aug. 16, 2012

(65) Prior Publication Data

US 2013/0205851 A1 Aug. 15, 2013

(30) Foreign Application Priority Data

Aug. 17, 2011 (DE) ..... 10 2011 110 939

(51) Int. Cl.

| | |
|---|---|
| ***B21B 21/04*** | (2006.01) |
| ***B21B 21/00*** | (2006.01) |
| ***B21B 37/78*** | (2006.01) |
| ***B21B 38/00*** | (2006.01) |
| ***B21B 38/04*** | (2006.01) |
| ***B21B 25/02*** | (2006.01) |

(52) U.S. Cl.

CPC ..... *B21B 21/04* (2013.01); *B21B 21/00* (2013.01); *B21B 37/78* (2013.01); *B21B 25/02* (2013.01); *B21B 38/00* (2013.01); *B21B 38/04* (2013.01)

(58) Field of Classification Search

CPC ..... B21B 37/78; B21B 21/00; B21B 38/00; B21B 25/02; B21B 38/04; G01B 11/0666; G01B 17/02

USPC ..... 72/9.2, 11.8, 12.7, 12.89, 18.8, 19.6, 72/19.7, 95, 96, 97, 208, 209, 214, 220, 72/370.01, 370.14

See application file for complete search history.

(56) References Cited

U.S. PATENT DOCUMENTS

| | | | | |
|---|---|---|---|---|
| 4,562,713 | A * | 1/1986 | Kondoh | B21B 21/005 414/431 |
| 4,674,312 | A | 6/1987 | Cook | |
| 5,548,987 | A | 8/1996 | Haeusler | |
| 6,257,040 | B1 * | 7/2001 | Baensch et al. | 72/214 |

(Continued)

FOREIGN PATENT DOCUMENTS

| | | | |
|---|---|---|---|
| CN | 2000002234 | A | 9/1995 |
| JP | 54019455 | A * | 2/1979 |

(Continued)

OTHER PUBLICATIONS

Translated document of JP54019455A to Tabamura (formerly Tsukamura) is attached.*

*Primary Examiner* — Peter DungBa Vo
*Assistant Examiner* — John S Lowe
(74) *Attorney, Agent, or Firm* — Andrew Wilford

(57) ABSTRACT

An apparatus for making a cold-pilger-rolled tube has two grooved pilger rolls rotatable about respective axes to compress a workpiece moving in a travel direction against a mandrel extending in the direction between a nip formed between the rolls and anchored upstream of the nip in a thrust block. Workpiece thickness is adjusted on the fly by measuring a wall thickness of the workpiece downstream in the direction from the roll as the workpiece passes through the nip and for displacing the thrust block and mandrel in to the travel direction as the workpiece passes through the nip in accordance with the measured wall thickness.

13 Claims, 1 Drawing Sheet

(56) References Cited

U.S. PATENT DOCUMENTS

| | | | | |
|---|---|---|---|---|
| 6,666,094 | B1 * | 12/2003 | Sauerland | 73/618 |
| 7,333,925 | B2 * | 2/2008 | Yamane | 703/9 |
| 8,490,492 | B2 * | 7/2013 | Groos et al. | 73/618 |

FOREIGN PATENT DOCUMENTS

| | | | |
|---|---|---|---|
| JP | 2000283729 | A | 10/2000 |
| JP | 2006159233 | A | 6/2006 |

* cited by examiner

METHOD AND APPARATUS FOR MAKING COLD-PILGER-ROLLED TUBES

FIELD OF THE INVENTION

The present invention relates to the manufacture of tubing. More particularly this invention concerns making cold-pilger-rolled tubes.

BACKGROUND OF THE INVENTION

A standard apparatus for making a tube has two grooved pilger rolls rotatable about respective axes to compress a metal tube moving in a travel direction against a mandrel extending in the direction between a nip formed between the grooved rolls. The mandrel is supported upstream of the nip in a thrust block and has a frustoconically tapered downstream portion extending through the nip so that as the tubular workpiece is compressed against the mandrel its diameter and wall thickness decrease. The rolls themselves are each formed with a substantially semicircular groove to impart the desired cylindrical outer surface to the workpiece.

Cold pilger rolling produces seamless tubes from a normally tubular metallic starting workpiece or blank to a finished product having cylindrical inner and outer surfaces. The purpose of pilger rolling is to reduce the outer diameter and wall thickness of seamless end product. The input stock here, known as the tube blank, is typically passed through a roll pair that has a conical pass design, and effects the rotational and feed motion intermittently on the tube blank. The rolling mandrel engages inside the tube blank.

When this approach is used, tubes are typically generated while maintaining especially stringent size tolerances of up to 5/100 mm. To perform quality control, the known approach has been to sample by removing and measuring tube samples after the forming process. Whenever the wall thickness threatened to depart from the tolerance range, or had already departed from this range, the rolling mill was shut down and the position of the rolling mandrel was corrected. However, this resulted in a situation where rapidly occurring changes in the wall thickness remained undetected and the rolling mill had to be regularly stopped for dimensional adjustment. Confirming that a dimensional adjustment had been successfully performed was also possible only after at least one more tube had been formed.

It would therefore be possible to perform nondestructive measurement of the forming result using, for example, conventional ultrasonic testing equipment. This approach is thwarted, however, by the especially small workpiece geometry and especially narrow tolerance specifications, and additionally by the lubricating film adhering to the workpiece and necessarily and unavoidably reaching the surface of the workpiece through the forming process.

U.S. Pat. No. 6,666,094 has already disclosed a method and an apparatus for effecting the noncontact online hot-wall-thickness testing of tubes. Here the impact of a pulsed laser against the wall of a hot-formed workpiece vaporizes not only the lubricating film adhering to the surface but also a small amount of the workpiece surface itself. The absorption of the laser energy within the tube surface and a partially effected vaporization of an extremely thin layer of the surface causes an ultrasonic pulse to be generated in the tube that enters the tube wall perpendicular to the tube surface. The ultrasonic pulse thereby generated is reflected from the inner surface of the tube back to the outer surface, is then reflected again, etc., with the result that an ultrasonic echo sequence of decreasing amplitude is created in the test material. The reflected ultrasonic pulse generates on the outer surface of the tube vibrations in the subminiature range that can in turn be detected in a noncontact procedure by a second laser operated in a continuous illumination mode by utilizing the Doppler effect.

The application of nondestructive testing methods for the cold-pilger-rolling process is, however, not known in the prior art. Instead, the testing methods used heretofore have continued to pursue the principle whereby measurement is performed after forming and sampling have been completed, individual or multiple forming parameters are then modified based on the test values, and finally the result of this parameter modification is then checked once again after a further completed forming process.

OBJECTS OF THE INVENTION

It is therefore an object of the present invention to provide an improved method of and apparatus for making cold-pilger-rolled tubes.

Another object is the provision of such an improved method of and apparatus for making cold-pilger-rolled tubes that overcomes the above-given disadvantages, in particular that enable the position adjustment of at least one forming tool to be effected during cold pilger rolling based on test data obtained during the forming process.

SUMMARY OF THE INVENTION

An apparatus for making a cold-pilger-rolled tube has two grooved pilger rolls rotatable about respective axes to compress a workpiece moving in a travel direction against a mandrel extending in the direction between a nip formed between the rolls and anchored upstream of the nip in a thrust block. Workpiece thickness is adjusted on the fly by measuring a wall thickness of the workpiece downstream in the direction from the roll as the workpiece passes through the nip and for displacing the thrust block and mandrel in to the travel direction as the workpiece passes through the nip in accordance with the measured wall thickness.

Thus according to the invention, a position adjuster is operatively linked to the mandrel thrust block, and also connected to the measuring device. Connecting the position adjuster to the measuring device is furthermore effected by means of a controller that is especially preferably connected to a data storage unit for adjustment and/or operational parameters.

This makes it possible for measurement data recorded during the forming process to affect the ongoing forming process, optionally online and preferably almost immediately. This is implemented according to the invention by actuating the position adjuster by which the position of the rolling mandrel can be adjusted. This not only results in enabling detected defects to be eliminated almost immediately, but the effects of the position adjustments on the rolling process as a whole can be tracked and corrected as required almost immediately.

In another advantageous embodiment of the invention, a deviation of the wall thickness from the specified value or tolerance range is detected during the forming process. This is especially advantageously effected by comparing measurement data with specifications and reference data stored in a controller, and, in particular, in the unit's memory. A device is thus created that in automated fashion monitors adherence to the required tolerances over the entire scope of the process, and preferably also ensures that appropriate actions are taken.

The measuring device is preferably a laser-ultrasonic (LASUS) measuring device of the type described in above-discussed U.S. Pat. No. 6,666,094 (whose entire disclosure is herewith incorporated by reference) that provides virtually nondestructive and reliable online measurement of the wall thickness of the cold-pilger-rolled tube using equipment that is easy to handle while achieving especially precise measurement results.

The wall thickness is typically not only measured when the tube is at one fixed position. Instead, the cold-pilger-rolling process produces regular rotation of the tube about its longitudinal axis. It is therefore possible to provide measurement coverage over the entire perimeter of the formed tube simply by means of the preferred fixed positioning of the measuring device and the relative motion of the tube produced thereby. The approach is also preferred where not only one measurement at one specific site on the tube is performed, but a plurality of measurements is performed while, for example, maintaining a specified frequency extending over the entire forming process. As a result, determining the recorded measurement data also enables the effect of any measurement errors to be minimized by simple means.

In an advantageous embodiment of the invention, the rolling mandrel is supported on at least one mandrel thrust block that includes at least one clamping wedge by which both the position adjustment of the rolling mandrel and also its fixation in a specified position can be effected. In an especially preferred approach, the motion of the at least one clamping wedge is effected by a clamping cylinder and/or a spindle. However, position adjustment of the mandrel thrust block by using one or more cylinders is similarly advantageous. As a result, an apparatus is created that enables a precise adjustment and fixation of the rolling mandrel at a specified position to be achieved by utilizing equipment that is easy to produce and handle. Adjustment to any desired position is effected here in stepless fashion.

What is also especially advantageous for achieving the object of the invention is a system where not only the rolling mandrel is mounted for adjustment in the rolling mill according to the invention, but also one where the forming tools that engage the tube from the outside, preferably the working rolls, are provided so as to be similarly adjustable. Appropriate adjustment means for the working rolls enables the roll gap to be adjusted preferably as desired, and optionally readjusted, thereby interacting with the rolling mandrel to produce a tube with the most precise possible roundness and smallest possible deviations from the specified values for outer diameter and wall thickness.

This is especially advantageously achieved when at least one forming tool engaging the tube from outside, preferably a working roll, is also connected to the measuring device. The result achieved thereby is that the position adjustment and readjustment of all of the forming tools involved in the forming process can be accomplished preferably fully automatically when the measurement data recorded by the measuring device is available to all of the forming tools.

In second aspect of the invention, a method is provided for making cold-pilger-rolled tubes by a rolling mill, which method uses a rolling mandrel supported on at least one mandrel thrust block and at least two forming tools engaging the tube from outside, as well as a measuring device to measure the wall thickness of the tube during the forming process. Based on the approach according to the invention, at least one position adjuster is connected to the measuring device through the mandrel thrust block and effects a position adjustment to affect the wall thickness whenever the measuring device detects a deviation in the wall thickness from a specified value or tolerance range. This method enables the advantages and effects to be achieved that were already mentioned above in connection with the first aspect of the invention.

An especially preferred approach is one where the position adjustment of the rolling mandrel is performed during the forming process, as the result of which a correction of the deviations determined during the forming process can be performed, preferably automatically.

The wall thickness is advantageous measured over the entire perimeter of the tube so as to enable both the uniformity of the wall thickness to be determined and also, optionally, the shape of the tube to be determined.

According to the invention, at least one, preferably exactly one fixed measuring device is provided by which the measurement of the wall thickness can also be effected over the entire perimeter of the tube. Through the partial rotation of the tube about its longitudinal axis, which occurs with each feed motion of the tube within the rolling mill, the measurement data can be recorded over the entire perimeter of the tube by especially simple means.

An especially preferred approach in implementing the method according to the invention is also one whereby, as required, at least one forming tool engaging the tube from outside is additionally adjusted in addition to the rolling mandrel so as to counteract any deviations in wall thickness from a specified value or tolerance range.

BRIEF DESCRIPTION OF THE DRAWING

The above and other objects, features, and advantages will become more readily apparent from the following description, reference being made to the accompanying drawing in which.

DETAILED DESCRIPTION

Figure 1:
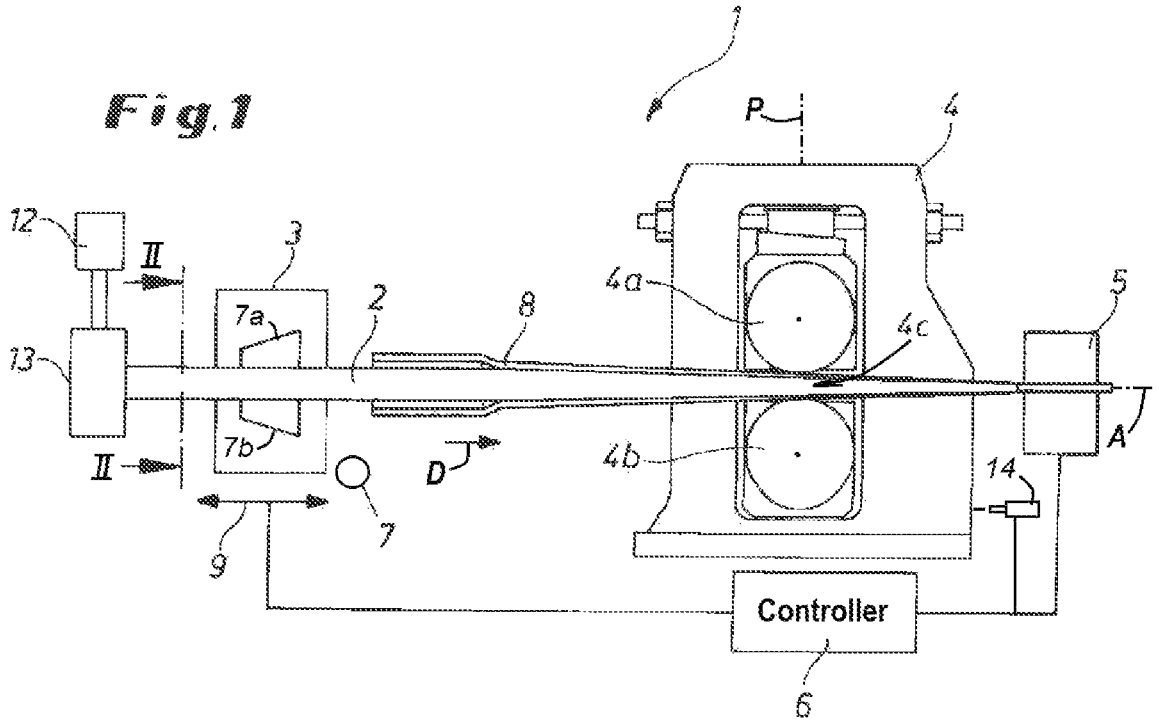
FIG. 1 is a schematic side view of an apparatus according to the invention.

As seen in FIG. 1 a rolling-mill apparatus 1 for making cold-pilger-rolled tubes has a mandrel 2 extending along an axis A, supported on a thrust block 3, and tapering uniformly in a downstream workpiece-travel direction D, as well as a limitedly horizontally reciprocal roll stand 4 carrying upper and lower work rolls 4*a* and 4*b* rotatable about respective horizontal and parallel axes vertically flanking the mandrel 2 and defining a nip 4*c*. The tube blank is formed as it runs through the apparatus 1 in the travel direction D from left to right in the apparatus 1. The actual forming is done between the tapered rolling mandrel 2 and the rolls 4*a* and 4*b* to create a tube 8 of constant wall thickness that can be measured in a measuring device 5. This device 5 is connected to a position detector 7 of the mandrel thrust block 3 by a controller 6, and can move the mandrel 2 both ways in the travel direction as shown by the arrow 9 and can control the angle of an the axis A of the mandrel 2 with respect to a plane P defined by the rotation axes of the rolls 4*a* and 4*b*. In addition an actuator shown schematically at 14 can rapidly reciprocate the roll stand 4 in a short stroke in the direction D as required by the controller 6, with at least one of the rollers 4*a* or 4*b* carrying a large pinion meshing with a stationary rack to rotate this roller as it is moved in the direction D.

Figure 2:
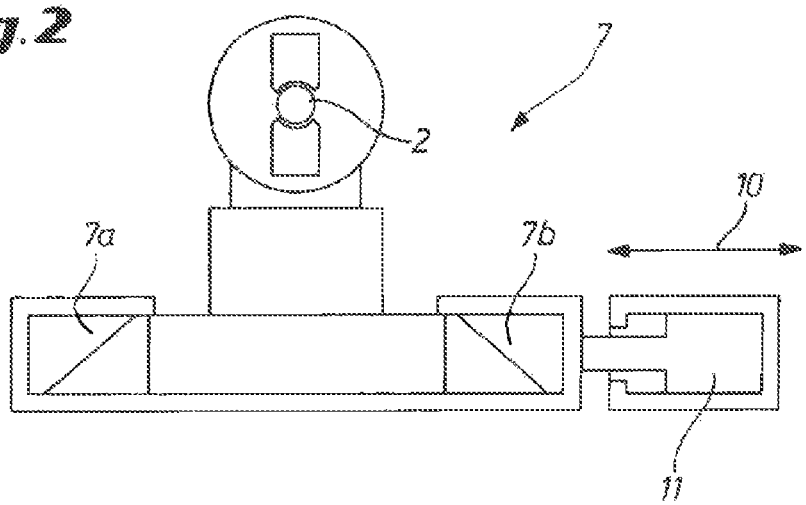
FIG. 2 is a section taken along line II-II of FIG. 1.

FIG. 2 shows the position adjuster 7 of the apparatus 1. The mandrel thrust block 3 is locked in place by clamping wedges 7*a* and 7*b*. The force required for this locking is applied as shown in FIG. 2 by a hydraulic cylinder 11 that can apply a force in the direction of double arrow 10 that is horizontal and transverse to the horizontal workpiece-travel direction. In order to perform fine corrections in the wall thickness of the finished tube during production, the rolling mandrel 2 here is typically moved in and opposite to the rolling direction D. The automatic adjustment is effected here, for example, by loosening the clamping cylinder(s) 11 actuating the clamping wedges 7*a* and 7*b* against unintended axial movement to the extent that the mandrel thrust block 3 can be moved by an adjustment actuator or motor 12 via a spindle lifter 13 (see FIG. 1) along or opposite to the rolling direction. After reaching the desired position in the direction of arrow 9, the clamping cylinder 11 is again loaded with the normal clamping force and the forming process is continued in the usual manner. The entire adjustment procedure can furthermore be effected not only automatically but also during the actual rolling process as well.

We claim:

1. An apparatus for making a cold-pilger-rolled tube, the apparatus comprising:

a reciprocating roll frame;

a thrust block upstream in a travel direction from the roll frame;

a mandrel extending downstream in the travel direction from the thrust block into the roll frame;

two grooved pilger rolls rotatable about respective axes in the reciprocating roll frame to compress a workpiece moving in the travel direction against the mandrel extending in the direction through a nip formed between the grooved rolls;

means for measuring a wall thickness of the workpiece downstream in the travel direction from the rolls as the workpiece passes through the nip; and means for displacing the thrust block and mandrel in or transverse to the travel direction as the workpiece passes through the nip in accordance with the measured wall thickness to correct nonuniformities in the wall thickness determined from the measured wall thickness.

2. The apparatus defined in claim 1, wherein the apparatus further comprises a controller that is connected between the means for measuring and the means for displacing and that determines if the workpiece has downstream of the rolls any nonuniformities in wall thickness.

3. The apparatus defined in claim 2, wherein the controller is provided with a memory.

4. The apparatus defined in claim 1, wherein the measuring device is a laser-ultrasound sensor.

5. The apparatus defined in claim 1, wherein the means for displacing includes a wedge engageable with the thrust block and an actuator for displacing the wedge.

6. The apparatus defined in claim 5, wherein the actuator is a fluid-powered cylinder or a spindle.

7. The apparatus defined in claim 6, wherein the means for displacing also includes an actuator for displacing one of the rolls in response to the measured wall thickness.

8. A method of operating a pilger-cold-rolling apparatus having two grooved pilger rolls rotatable about respective axes to compress a workpiece moving in a travel direction against a mandrel extending in the direction between a nip formed between the grooved rolls and anchored upstream of the nip in a thrust block, the method comprising the steps of:

measuring a wall thickness of the workpiece downstream in the travel direction the roll as the workpiece passes through the nip; and displacing the thrust block and mandrel in or transverse to the travel direction as the workpiece passes through the nip in accordance with the measured wall thickness when same lies outside a predetermined range to correct nonuniformities in wall thickness detected from the measurements of the workpiece wall thickness.

9. The method defined in claim 8, further comprising the steps of:

storing set points for workpiece wall thickness in a memory;

comparing the measurements of the wall thickness with the set points; and generating corrective signals for displacing the thrust block and mandrel when the output varies from the set points.

10. The method defined in claim 8, wherein a controller connected between an actuator for displacing the thrust block and a wall thickness sensor downstream of the nip controls the thrust-block displacement.

11. The method defined in claim 8, wherein the wall thickness is measured using laser light and ultrasound detection.

12. The method defined in claim 8, wherein the workpiece wall thickness is measured at several locations spaced angularly around the workpiece.

13. The method defined in claim 8, further comprising the step of moving at least one of the rolls as the workpiece passes through the nip in accordance with the measured wall thickness when same lies outside a predetermined range.

* * * * *